US008154237B2

(12) United States Patent
Higashikata

(10) Patent No.: US 8,154,237 B2
(45) Date of Patent: Apr. 10, 2012

(54) SEALED ELECTRIC COMPRESSOR

(75) Inventor: Isao Higashikata, Nagoya (JP)

(73) Assignee: Ubukata Industries, Co., Ltd, Nagoya-Shi, Aichi (JP)

( * ) Notice: Subject to any disclaimer, the term of this patent is extended or adjusted under 35 U.S.C. 154(b) by 325 days.

(21) Appl. No.: 12/670,540

(22) PCT Filed: Feb. 25, 2008

(86) PCT No.: PCT/JP2008/000330

§ 371 (c)(1),
(2), (4) Date: Jan. 25, 2010

(87) PCT Pub. No.: WO2009/016779

PCT Pub. Date: Feb. 5, 2009

(65) Prior Publication Data

US 2010/0207563 A1 Aug. 19, 2010

(30) Foreign Application Priority Data

Jul. 31, 2007 (JP) ..... 2007-199887

(51) Int. Cl.
*H01H 37/32* (2006.01)
*H01H 85/04* (2006.01)
*H01H 35/24* (2006.01)

(52) U.S. Cl. ..... 318/481; 318/471; 62/228.3; 417/38

(58) Field of Classification Search ..... 318/471–473, 318/481, 645; 62/132, 190, 215, 217, 226, 62/228.1, 228.3; 310/52–54, 63, 89; 335/6, 335/15, 65, 68; 337/2–6, 14–17, 114, 125, 337/221; 361/1, 23, 25–27, 103, 104; 417/29–32, 417/35, 38, 44.1, 44.2, 45, 228, 279, 321
See application file for complete search history.

(56) References Cited

U.S. PATENT DOCUMENTS

| | | | | | |
|---|---|---|---|---|---|
| 3,278,111 | A | * | 10/1966 | Parker | 417/32 |
| 3,302,695 | A | * | 2/1967 | Payne | 165/260 |
| 4,332,528 | A | * | 6/1982 | Hammele | 417/45 |
| 4,388,046 | A | * | 6/1983 | Boller | 417/295 |
| 6,542,062 | B1 | * | 4/2003 | Herrick | 337/102 |

FOREIGN PATENT DOCUMENTS

| | | |
|---|---|---|
| JP | A-H08-261160 | 10/1996 |
| JP | A-H11-287184 | 10/1999 |
| JP | A-H10-073082 | 12/1999 |
| JP | A-2002-227771 | 8/2002 |

OTHER PUBLICATIONS

International Search Report, dated Apr. 24, 2008, for International Patent Application No. PCT/JP2008/000330, filed on Feb. 25, 2008.

* cited by examiner

*Primary Examiner* — Bentsu Ro
(74) *Attorney, Agent, or Firm* — Thomas & Karceski, PC

(57) ABSTRACT

A sealed electric compressor having a normally-off type pressure switch and a fuse element. The pressure switch is placed in a sealed housing, connected parallel to a main winding of an electric motor, and, when the pressure of refrigerant in the sealed housing is abnormally high, activates to short-circuit the main winding. The fuse element is connected in series to the main winding and an auxiliary winding of the electric motor and interrupts conduction of electricity to the electric motor when an excess current that is produced when the pressure switch short-circuits the main winding flows.

6 Claims, 8 Drawing Sheets

SEALED ELECTRIC COMPRESSOR

CROSS-REFERENCE TO RELATED APPLICATION(S)

This is a National Stage Entry into the United States Patent and Trademark Office from International PCT Patent Application No. PCT/JP2008/000330, having an international filing date of 25 Feb. 2008, which relies for priority on Japanese Patent Application No. JP 2007-199887. filed on 31 Jul. 2007, the contents of both of which are incorporated herein by reference.

TECHNICAL FIELD

The present invention relates to a sealed electric refrigerant compressor used with air conditioners.

BACKGROUND ART

For example, Japanese Patent No. 3010141 discloses a sealed electric refrigerant compressor, which will be described with reference to FIG. 8. The sealed electric compressor 101 includes a metal lower housing 102A in which are housed a compressor 103 and an electric motor 104 driving the compressor 103. The lower housing 102A has an opening, and an upper housing 102B is welded to the lower housing 102A along an entire periphery of the opening in a gastight manner, whereby a sealed housing is constituted.

A suction pipe 105 for introducing refrigerant into the compressor 103 extends through the lower housing 102A. A discharge pipe 106 through which compressed refrigerant is supplied to an external heat exchanger (not shown) or the like extends through the upper housing 102B to be fixed. Furthermore, the upper housing 102B is provided with a hermetic terminal 107 for connecting the motor 104 in the sealed housing and an external power source (not shown). A plurality of electrically conductive terminal pins 107A extend through a metal plate constituting the hermetic terminal 107. These plural terminal pins 107 are hermetically insulated and fixed by an electrically insulative sealing material such as glass. A lead wire 108 and a thermally responsive protector 109 both to be connected to a winding of the motor 104 are connected to a part of the conductive terminal pin 107A located inside the sealed housing.

The thermally responsive protector 109 has a thermally responsive contact mechanism (a thermally responsive switch) comprising a thermally responsive element such as a bimetal. The thermally responsive protector 109 is connected in series to the motor 104 which is energized with an operating current. Furthermore, the thermally responsive protector 109 is directly exposed to the refrigerant in the sealed housing. Accordingly, when overcurrent flows in the motor 104 for any cause or when an ambient temperature rises for any cause, the thermally responsive protector 109 is operated to interrupt energization of the motor 104. As a result, the motor 104 can be prevented from overheat or burning due to overload or overcurrent.

DISCLOSURE OF THE INVENTION

Problem to be Overcome by the Invention

The motor 104 is overloaded when the refrigerant pressure rises in the sealed housing. Accordingly, an amount of current flowing in the motor 104 and the temperature of the motor 104 are gradually increased. To protect the motor 104 from such an overloaded state, the thermally responsive protector 109 is operated to interrupt energization of the motor 104.

However, any cause (the clogging of the discharge pipe 106 or the like) rarely raises the refrigerant pressure suddenly. In this case, the refrigerant temperature and current are increased relatively slower although a pressure rise rate is sharp. As a result, a part exposed to high pressure, such as piping, is sometimes damaged before the conventional thermally responsive protector 109 interrupts energization of the motor 104. Furthermore, reduction in an amount of refrigerant renders the cooling of the motor 104 insufficient, resulting in burnout of the motor 104. This results in serious damage not only to the compressor 103 but also to the periphery thereof.

Accordingly, sealed electric compressors have necessitated a protecting function that can reliably interrupt energization of the motor in the case of sudden rise of refrigerant pressure as well as in the case of temperature rise or overcurrent state. Furthermore, when a pressure vessel (the sealed housing) is repeatedly subjected to high pressure, deterioration tends to progress in a relatively weaker part of the pressure vessel. Particularly a rise in the temperature of the sealed housing under high pressure condition increases the possibility of breakage of the glass terminal (the hermetic terminal 107) comprising the conductive terminal pins 107A inserted through the metal plate. Under these circumstances, a protector has been desired which reliably performs interrupt of energization of the motor.

An object of the present invention is to provide a sealed electric compressor which can protect a part subjected to high pressure, such as piping, and the motor when the pressure in the sealed housing is in an extraordinary state.

Means for Overcoming the Problem

The present invention provides a sealed electric compressor which includes a sealed metal housing which houses an electric motor and a compressor therein, a hermetic terminal provided in the sealed housing and having a plurality of conductive terminal pins conducting electric current between an interior and an exterior of the sealed housing, a main winding and an auxiliary winding of the motor both connected to the conductive terminal pins, wherein the compressor compresses a refrigerant with the interior of the sealed housing serving as a refrigerant path, characterized by a normally-off type pressure switch disposed in the sealed housing and connected in parallel to the main winding, the pressure switch being operated to short-circuit the main winding when a refrigerant pressure in the sealed housing rises to an extraordinary high pressure state, and a fuse element which is connected in series to the main winding and the auxiliary winding and interrupts energization of the motor when an overcurrent flows in the motor with the main winding being short-circuited by the pressure switch.

According to the construction, the pressure switch reliably detects an extraordinary rise in the refrigerant pressure in the sealed housing thereby to short-circuit the main winding of the motor although the extraordinary rise could not have been detected in the conventional art. When the main winding is then short-circuited such that an overcurrent flows in the main winding, the fuse element interrupts energization of the motor. Thus, the sealed electric compressor can interrupt energization of the motor when the pressure in the sealed housing is in an extraordinary state.

Furthermore, it is good that the fuse element is disposed in the sealed housing. According to the construction, the motor to which energization has been stopped due to an extraordinary increase in the pressure can be prevented from being restarted since the fuse element is unreplaceable. This can prevent an occurrence of breakage due to repeated subjection of the sealed housing to extraordinary pressure.

Furthermore, it is good that a thermally responsive protector is connected in series to the motor and energizes the motor with an operating current so as to protect the motor and that the thermally responsive protector includes a circuit at least a part of which operates as the fuse element. According to the construction, the energization of the motor can reliably be interrupted by meltdown of the fuse element. Also, the number of components can be reduced such that the sealed electric compressor can easily be manufactured and handled.

Furthermore, it is good that a thermally responsive contact mechanism and a heater operated as the fuse element are disposed in the hermetic metal container and connected in series to each other. In this case, it is good that the thermally responsive contact mechanism has an electrical end connected to the main Winding and the heater has an electrical end connected via the conductive terminal pin to a power source. Furthermore, it is good that the pressure switch has one of two ends connected in parallel to the main winding and the other end connected to an electrical neutral point between the thermally responsive contact mechanism and the heater.

Effect of the Invention

According to the sealed electric compressor according to the present invention, even when any cause clogs the refrigerant path, an extraordinary rise in the compressed refrigerant pressure is detected such that energization of the motor can be interrupted. Accordingly, energization of the motor can reliably be interrupted in an extraordinary state of the pressure in the sealed housing as well as under an overcurrent condition and overheated condition. Consequently, a part exposed to high pressure, such as piping, can be prevented from breakage or the motor can be prevented from burnout.

EXPLANATION OF REFERENCE SYMBOLS

Reference symbols 1, 11, 21, 31 and 41 each designate a sealed electric compressor; 2 a sealed housing; 3 an electric motor; 3A a main winding; 3B an auxiliary winding; 4 a power source; 6, 16 and 56 each a fuse element; 7 and 17 each a pressure switch; 12 and 51 each a thermally responsive protector; 16 and 56 each a heater, and 18 a pressure protection unit.

BEST MODE FOR CARRYING OUT THE INVENTION

First Embodiment

Figure 1:
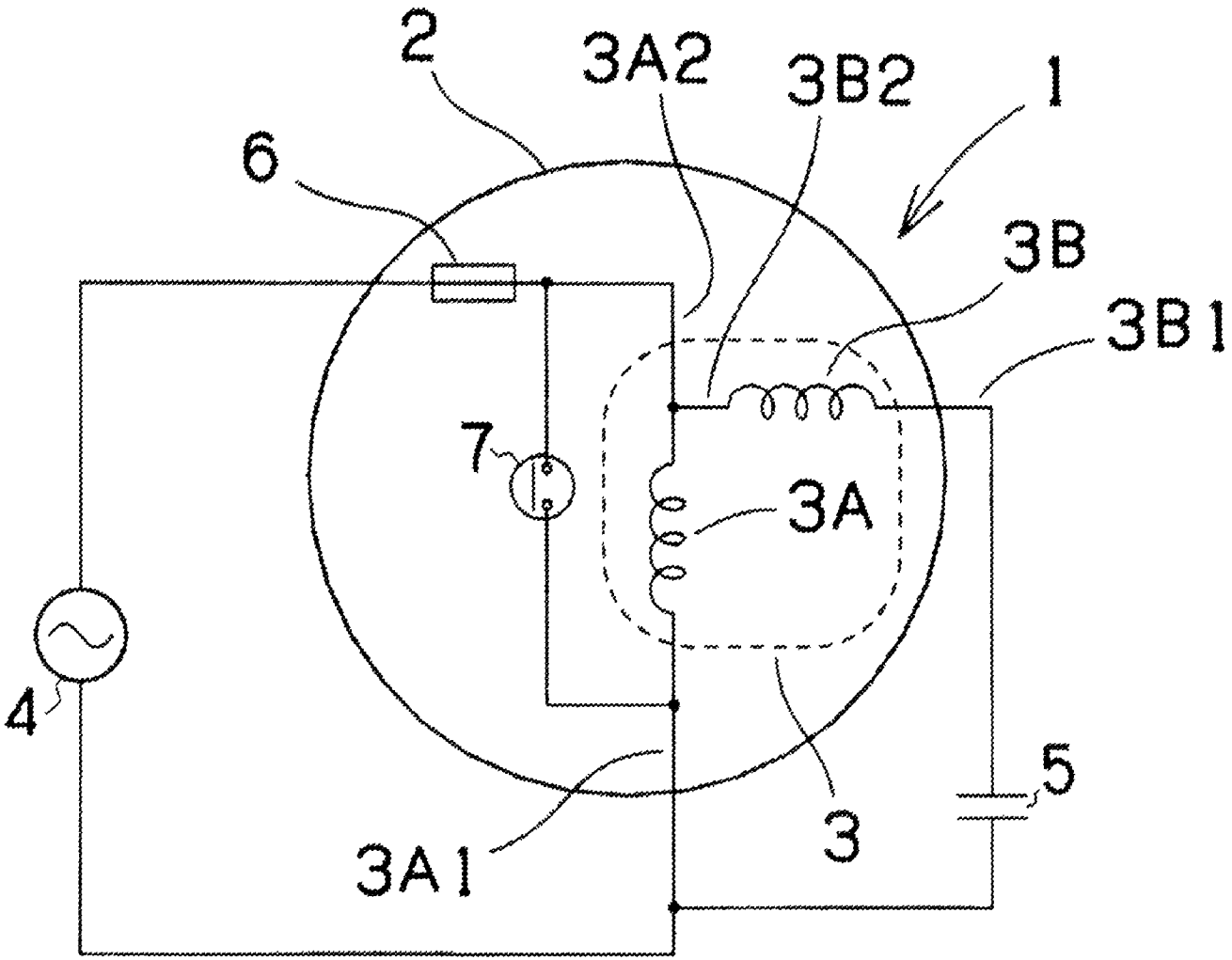
FIG. 1 is a wiring diagram of a sealed electric compressor in accordance with a first embodiment of the present invention.
Figure 8:
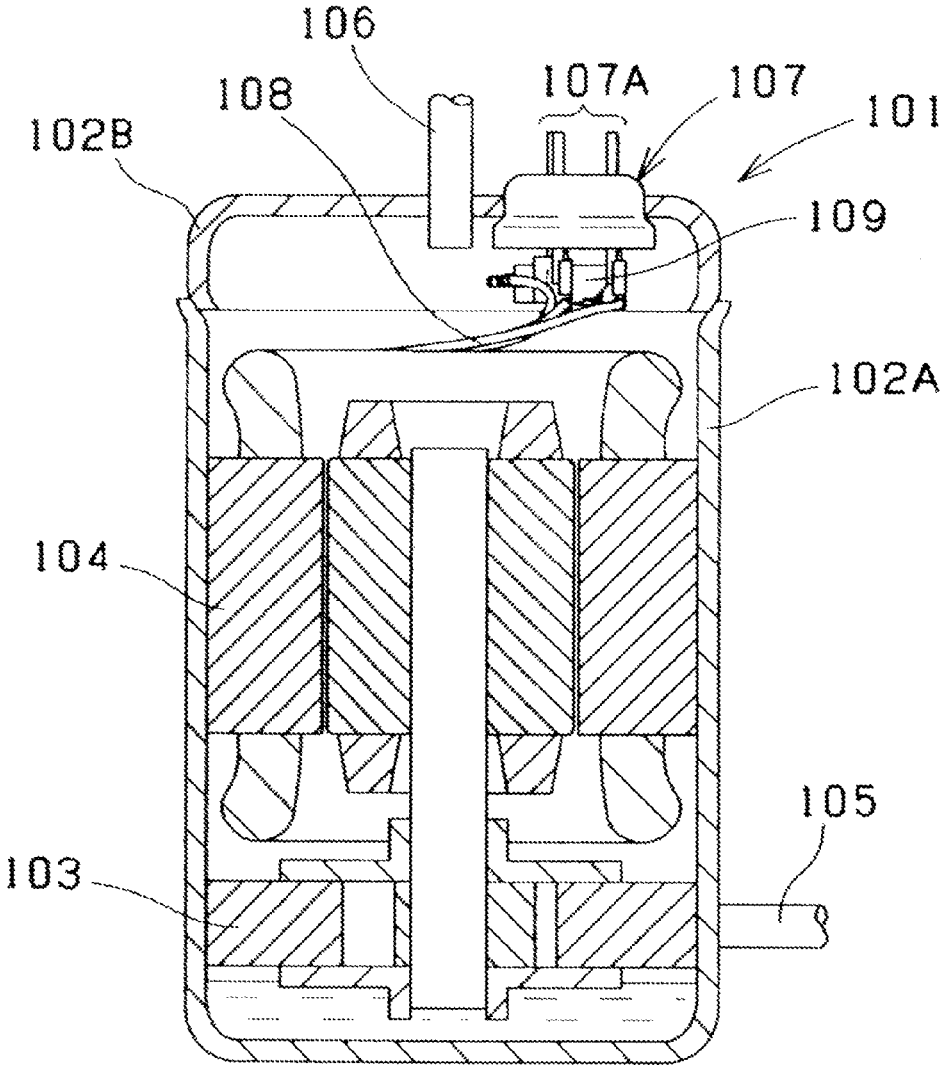
FIG. 8 is a sectional view showing an example of structure of sealed electric compressor.

A first embodiment of the present invention will be described with reference to FIG. 1. FIG. 1 is a wiring diagram showing circuit arrangement of a single-phase sealed electric compressor 1. The sealed electric compressor 1 comprises a compressor, hermetic terminals, electrically conductive terminal pins, a suction pipe and a discharge pipe as a sealed electric compressor 101 shown in FIG. 8 although none of these components are shown. An electric motor 3 and a compressor driven by the motor 3 are provided in a sealed housing 2 of the sealed electric compressor 1. The compressor compresses a refrigerant and discharges the compressed refrigerant from the discharge pipe with the sealed housing 2 serving as a refrigerant path.

A main winding 3A of the motor 3 has one end 3A1 connected via the conductive terminal pin of the hermetic terminal to one of poles of a single-phase power source 4 located outside the sealed housing 2. The aforesaid hermetic terminal conducts electric current between an interior and an exterior of the sealed housing 2. Furthermore, an auxiliary winding 3B of the windings of the motor 3 has one end 3B1 connected via the conductive terminal pin of the hermetic terminal to one end of a starting capacitor 5 located outside the sealed housing 2. The starting capacitor 5 further has the other end connected to one end 3A1 of the main winding 3A.

The auxiliary winding 3B has the other end 3B2 connected to the other end 3A2 of the main winding 3A of the motor 3. The fuse 6 has one end also connected to the other end 3A2 of the main winding 3A. The fuse 6 has the other end extending through the sealed housing 2 to be connected to the power source 4. More specifically, the fuse 6 is serially disposed between a connecting point of the main and auxiliary windings 3A and 3B of the motor 3 and the power source 4. As the result of the above-described arrangement, the fuse 6 is connected in series to the main and auxiliary windings 3A and 3B of the motor 3.

Furthermore, a normally-off type pressure switch 7 is connected in parallel to the main winding 3A between both ends 3A1 and 3A2 of the main winding 3A. The pressure switch 7 is disposed in the sealed housing 2 and connects the contacts thereby to short-circuit the main winding 3A of the motor 3 when a refrigerant pressure in the sealed housing 2 extraordinarily rises to exceed a predetermined pressure (when a refrigerant pressure in the sealed housing 2 is extraordinarily high).

An operating current flows via the fuse 6 during a normal operation of the sealed electric compressor 1. In this case, the motor 3 can continuously be operated since the operating current is sufficiently lower than a melting current of the fuse 6. When any cause (the clogging of the discharge pipe, for example) impedes the refrigerant discharged from the compressor from flowing forward, the refrigerant pressure rises while the compressor is being driven by the motor 3. Since a discharge pressure higher than in a normal state is applied to the compressor, the motor 3 serving as a drive source is overloaded. However, the current value of the motor 3 cannot melt the fuse 6 within a short period of time. As a result, the motor 3 continues operating in the overloaded state. When the motor 3 continues operating in the overloaded state as described above, there is a possibility that piping or the like may be damaged by the pressure or that the sealing member (a glass-sealed portion) of the hermetic terminal (a hermetic terminal) may be broken.

In view of the foregoing problem, the pressure switch 7 electrically connected in parallel to the main winding 3A of the motor 3 short-circuits both ends of the main winding 3A when the refrigerant pressure exceeds a predetermined value. As a result, a short-circuit current (overcurrent) flows in the circuit. The fuse 6 disposed in series to the motor 3 is melted by the short-circuit current, thereby interrupting energization of the motor 3.

The fuse 6 is encapsulated in a hermetic container made of a metal so that arc or scattered debris can be prevented from affecting the periphery thereof. Furthermore, the fuse 6 has a meltdown characteristic so selected that the fuse 6 is prevented from meltdown by application of a normal operating current thereto.

When the pressure of discharged refrigerant in the sealed electric compressor rises extraordinarily, the pressure switch 7 is operated so that the short-circuit current flows. As a result, the fuse 6 is melted down such that the motor 3 is unable to restart. When the refrigerant pressure extraordinarily rises up to an operating pressure set on the pressure switch 7, the motor 3 is interrupted thereby to interrupt compression of the refrigeration. There is a high possibility that the piping, the sealed part of the hermetic terminal or the like is already damaged by the risen pressure. When the motor 3 is restarted repeatedly in this state, there is a possibility that the piping, the sealed part of the hermetic terminal or the like may be broken. Accordingly, the restart of the motor 3 is disabled by the meltdown of the fuse 6.

The fuse 6 is a current fuse that melts down a metal by current. However, the fusing element should not be limited to the fuse 6. Another method may be employed that cuts off an electrical path by the increase in the current value with the short-circuit of the winding (the main winding 3A in this case). Furthermore, the operating pressure of the pressure switch 7 may be set so that the damage of the piping or the like during operation of the pressure switch 7 has substantially no problems. In this case, the motor 3 may or may not be non-returnable. A protector having a repeatedly operable switching mechanism may be used, instead of the fuse 6.

Second Embodiment

Figure 2:
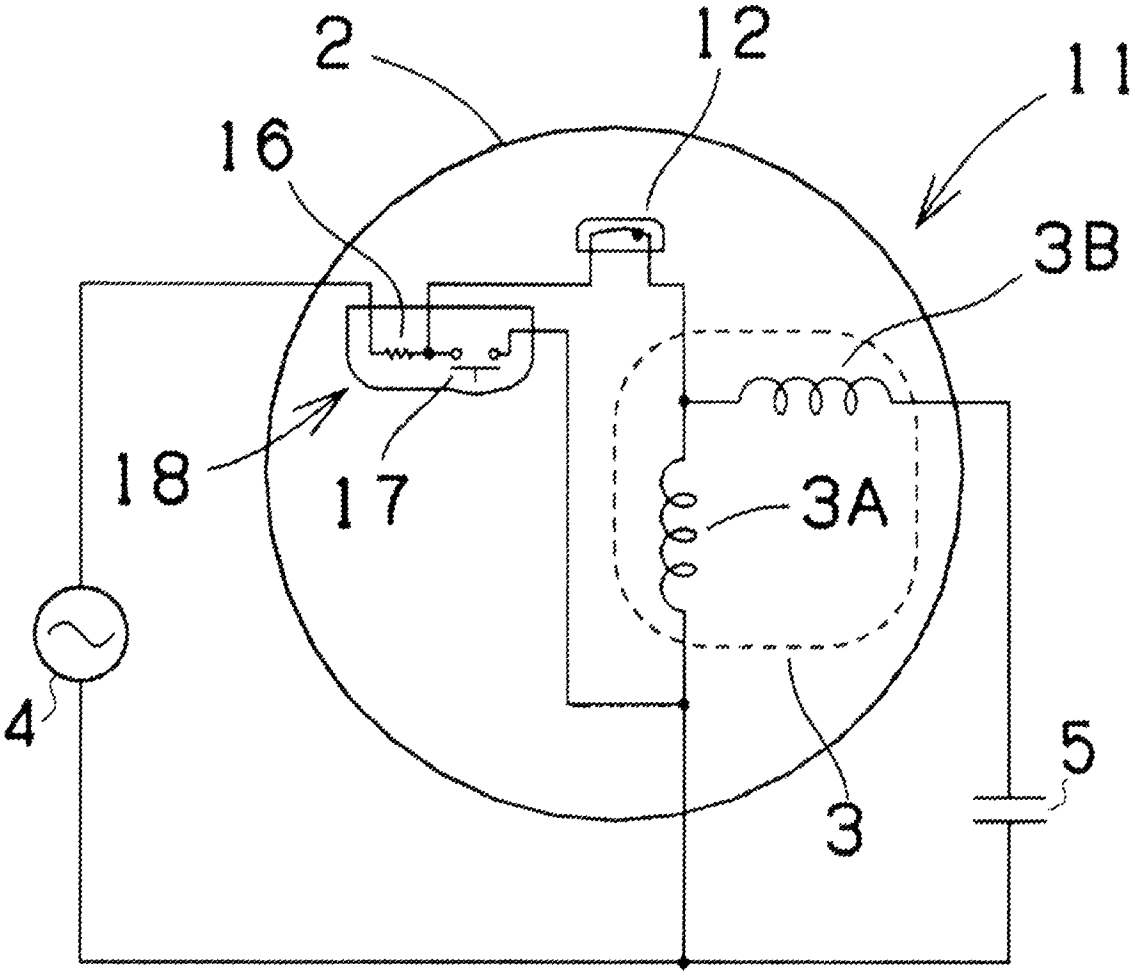
FIG. 2 is a view similar to FIG. 1, showing a second embodiment of the invention.
Figure 3:
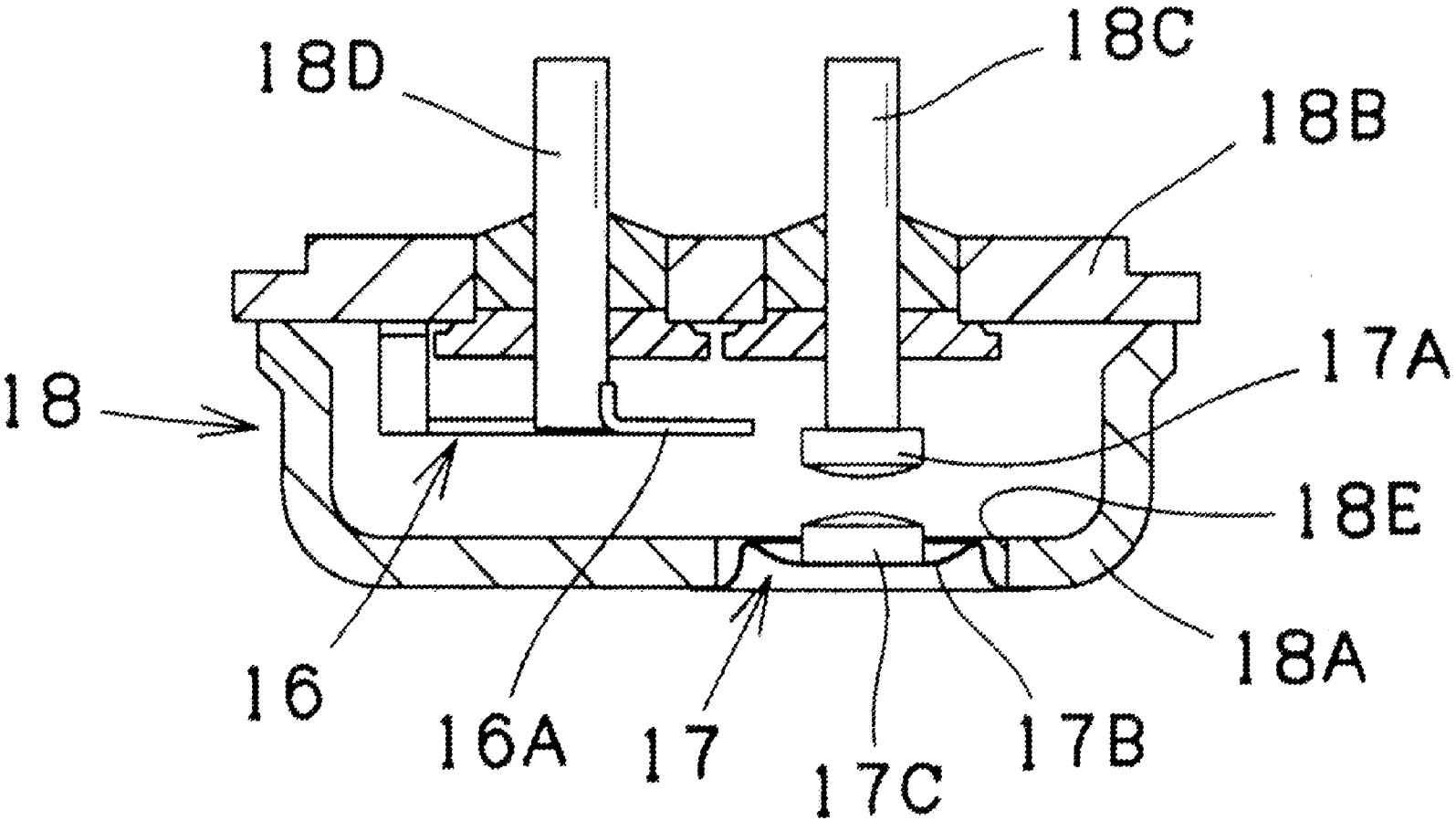
FIG. 3 is a sectional view of an example of pressure protection unit for use with the sealed electric compressor as shown in FIG. 2.

A second embodiment of the invention will be described with reference to FIGS. 2 and 3. FIG. 2 is a wiring diagram showing the circuit arrangement of the sealed electric compressor 11 of the second embodiment. FIG. 3 is a sectional view of an example of pressure protection unit for use with the sealed electric compressor as shown in FIG. 2. Identical or similar parts in the second embodiment are labeled by the same reference symbols as those in the first embodiment, and the description of these components will be eliminated.

The motor 3 is also disposed in the sealed housing 2 of the sealed electric compressor 11. Furthermore, the main winding 3A has one end directly connected to the power source 4. The auxiliary winding 3B has one end connected via the starting capacitor 5 to the power source 4. In the second embodiment, a thermally responsive protector 12 is provided and has one end connected in series to the main and auxiliary windings 3A and 3B of the motor 3. The thermally responsive protector 12 has the other end connected via a pressure protection unit 18 to the power source 4. More specifically, the thermally responsive protector 12 is serially connected between the motor 3 and the power source 4.

The pressure protection unit 18 includes the pressure switch 17 and the fuse 16 both integrally formed therewith. The thermally responsive protector 12 is electrically connected to the middle between the pressure switch 17 and the fuse 16. Each of the main winding 3A of the motor 3 and the thermally responsive protector 12 is connected so as to be electrically in parallel to the pressure switch 17. Furthermore, each of the motor 3 and the pressure switch 17 is connected in series to the fuse 16.

The structure of the pressure protection unit 18 will now be described with reference to FIG. 3. The pressure protection unit 18 comprises a metal container 18A and a header plate 18B welded to an entire periphery of an opening of the container 18A, both of which are formed into a gastight container. Conductive terminals 18C and 18D are inserted through the header plate 18B and insulated from and fixed to the header plate 18B by an electrically insulating filler such as glass. The conductive terminal 18C has a part which is located in an interior of the sealed container and to which a fixed contact 17A of the pressure switch 17 is fixed. The fixed contact 17A constitutes a switching mechanism together with a movable contact 17C as will be described later. Furthermore, a fuse 16 with a function of a fuse element has one end 16A connected to the other conductive terminal 18D. The fuse 16 has the other end fixed to the header plate 18B.

The container 18A has an opening 18E in which a metal diaphragm 17B is secured to an entire periphery of the opening 18E. The diaphragm 17B is formed into the shape of a dish by drawing. A movable contact 17C is electrically conductively secured to a part of the diaphragm 17B located at the sealed container interior side. The movable contact 170 is designed to be contactable with the aforesaid fixed contact 17A. The diaphragm 17B normally holds the movable contact in such a state that the movable contact 17C is not brought into contact with the fixed contact 17A. When an external pressure exceeds a predetermined value, the diaphragm 17B reverses its curvature so as to be thrust inside the sealed container, thereby contacting the fixed and movable contacts 17A and 17C together.

The thermally responsive protector 12 connected in series to the motor 3 is arranged to open and close the contact mechanism in response to an overcurrent or a rise in an ambient temperature in an overloaded state. More specifically, the thermally responsive protector 12 has a thermally responsive contact mechanism (a thermally responsive switch) in which a thermally responsive element such as a bimetal is operated with a snap action, thereby reliably cutting off an electrical path to the motor 3 in response to an overcurrent state or an overheated state.

The sealed electric compressor 11 causes the operating current of the motor 3 to flow via the thermally responsive protector 12 and the fuse 16 in the pressure protection unit 18 during a normal operation. In this case, the thermally responsive protector 12 is not operated since self-heating of the thermally responsive protector 12 is in equilibrium with an amount of heat taken by the refrigerant flowing in the periphery within an allowable range. Furthermore, since the fuse 16 does not reach a current value at which the fuse 16 is melted down as the fuse element, the sealed electric compressor 11 can continuously be operated without cutoff of the electrical path.

When any cause (the compressor's falling into an overloaded state) produces overcurrent or raises the refrigerant temperature, the equilibrium between the self-heating of the protector 12 and the cooling by the refrigerant is lost such that the temperature rises to exceed the predetermined value. As a result, the thermally responsive contact mechanism of the thermally responsive protector 12 is operated to interrupt energization of the motor 3. The fuse 16 is designed not to melt down in response to a temporary temperature rise and current value increase both occurring in this case. Accordingly, in the case where the overloaded state has been resolved upon recovery of the thermally responsive protector, the current value and the amount of heat produced return to respective normal values, whereupon the sealed electric compressor 1 can continuously be operated again.

The discharge pressure is increased when some cause clogs the discharge pipe such that the refrigerant pressure is increased. As a result, the load of the motor 3 driving the compressor is increased. However, the current value is increased relatively more gently, which state differs from the condition where the motor 3 is completely locked. Accordingly, the current is not increased to such an amount that the thermally responsive protector 12 is driven within a short period of time. Thus, there is a possibility that the sealing member (a glass-sealed portion) of the hermetic terminal (a hermetic terminal) and piping may be damaged by extraordinary pressure before the thermally responsive protector 12 is operated. In view of the problem, the pressure switch 17 connected in parallel to the main winding 3A of the motor 3 short-circuits both ends of the motor 3 thereby to cause a short-circuit current to flow when the refrigerant pressure in the sealed housing 2 rises to an extraordinary value. The fuse 16 is operated (or melts down) in response to the short-circuit current, thereby interrupting energization of the motor 3.

The pressure switch 17 is exemplified as completely short-circuiting the main winding 3A of the motor 3 in the embodiment. In this case, the short-circuit current is obviously larger than a current value in an overloaded state which operates the thermally responsive contact mechanism. Accordingly, when the operating current of the fuse 16 is set at a sufficiently large value, the thermally responsive contact mechanism is reliably operated earlier than the fuse 16 in an overloaded state where the motor 3 is locked.

However, the fuse 16 necessitates the performance of interrupting a large current in this case. Accordingly, a current-limiting resistor may be connected in series to the pressure switch 17 to control the short-circuit current. Furthermore, the main winding 3A may be short-circuited via a lead wire drawn from the middle thereof for the purpose of controlling the short-circuit current, instead of short-circuiting the whole main winding 3A of the motor 3. In this case, too, a protecting operation in the overloaded state can definitely be discriminated from a protecting operation under an extraordinary pressure condition or vice versa when the short-circuit current is rendered sufficiently larger than the operating current of the thermally responsive protector 12.

Third Embodiment

Figure 4:
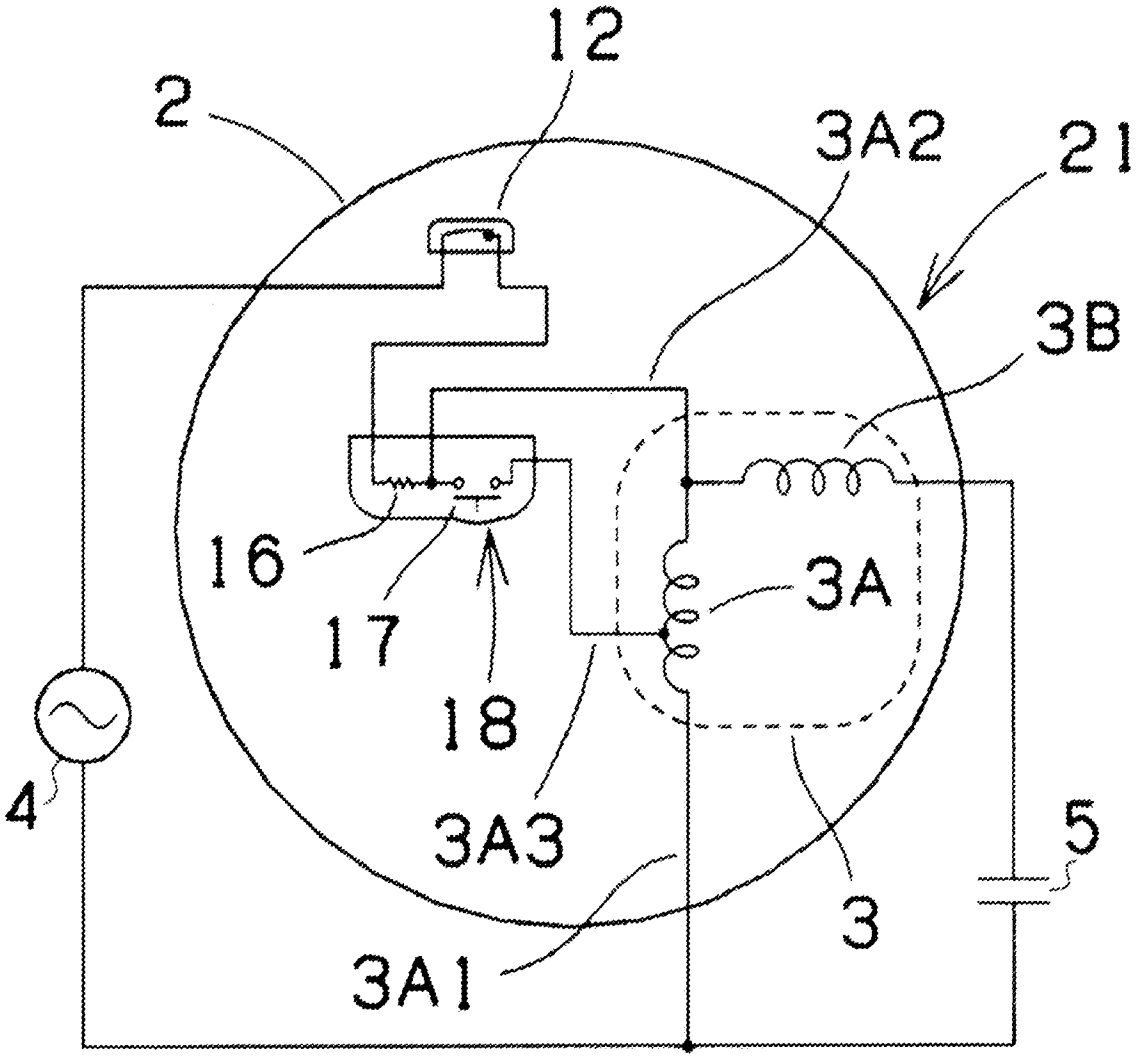
FIG. 4 is a view similar to FIG. 1, showing a third embodiment of the invention.

A third embodiment of the invention will be described with reference to FIG. 4. Identical or similar parts in the third embodiment are labeled by the same reference symbols as those in each foregoing embodiment, and the description of these components will be eliminated. In the sealed electric compressor 11 of the foregoing second embodiment, the pressure switch 17 of the pressure protection unit 18 is electrically connected so as not to be in series to the thermally responsive protector 12. The reason for this connecting manner comes from the purpose of preventing the thermally responsive protector 12 from falling into an unexpected destruction due to arc during current interrupt in the case where a short-circuit current far exceeding the operating current flows into the thermally responsive protector 12.

For the above-described reason, when the short-circuit current can be suppressed to an appropriate value, for example, by disposing the pressure switch 17 in series to a limiting resistor, as described above, the pressure switch 17 may be connected in series to the thermally responsive protector 12. Furthermore, as in the sealed electric compressor 21 shown in FIG. 4, for example, a lead wire 3A3 maybe drawn from the middle of the main winding 3A of the motor 3 to be connected to the pressure switch 17, which may be connected via the fuse 16 in series to the thermally responsive protector 12. In this case, the freedom in the disposition of the thermally responsive protector 12 can be improved and the thermally responsive protector 12 can be handled more easily.

Fourth Embodiment

A fourth embodiment of the invention will be described with reference to FIG. 5. Identical or similar parts in the fourth embodiment are labeled by the same reference symbols as those in each foregoing embodiment, and the description of these components will be eliminated. The foregoing third embodiment presents the pressure protection unit 18 comprising the fuse 16 and the pressure switch 17 integrated with each other. However, the fuse 16 and the pressure switch 17 may be individual components as the fuse 6 and the pressure switch 7 of the sealed electric compressor 1 in the foregoing first embodiment.

Figure 5:
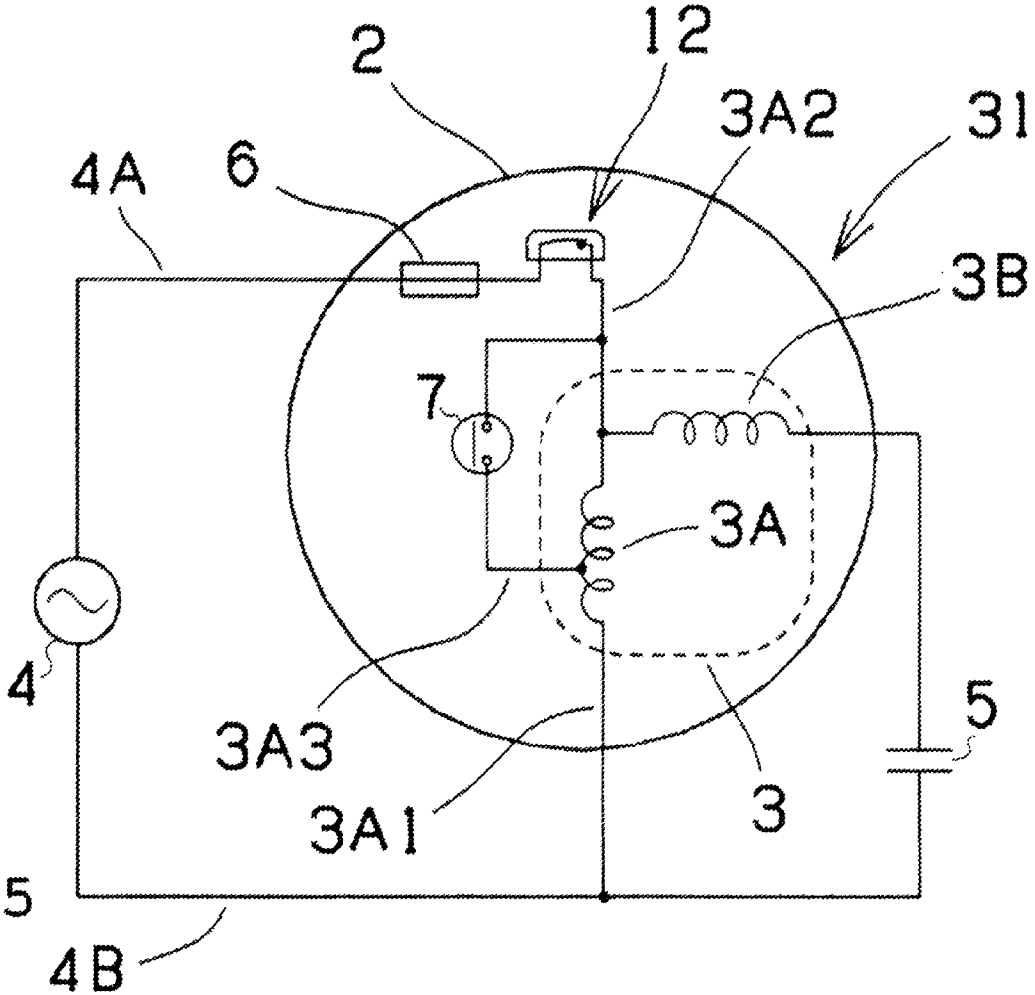
FIG. 5 is a view similar to FIG. 1, showing a fourth embodiment of the invention.

In this case, as a sealed electric compressor 31 in FIG. 5, the thermally responsive protector 12 having the thermally responsive contact mechanism may be disposed between the fuse 6 and the pressure switch 7. Furthermore, the fuse 6 and the pressure switch 7 both of which are individual components may be set in a single electrically insulating casing so as to compose a protecting unit, for example.

Fifth Embodiment

A fifth embodiment of the invention will be described.

Identical or similar parts in the fifth embodiment are labeled by the same reference symbols as those in each foregoing embodiment, and the description of these components will be eliminated. The fuse element (the fuse 6 or 16) is disposed in the sealed housing 2 of the sealed electric compressor 1, 11, 21 or 31 in each foregoing embodiment. However, the fuse element need not be disposed in the sealed housing 2 but can be mounted on the outside of the sealed housing 2.

For example, when the fuse element is mounted on the outside of the sealed housing 2, whether the fuse element has been operated or not can be confirmed more easily in the occurrence of interrupt of the motor 3, whereupon the cause for the interrupt can be grasped more easily. When the fuse element is mounted on the outside of the sealed housing 2, too, the location of the fuse element may be determined so as to be connected in series to the main winding 3A and the auxiliary winding 3B of the motor 3. For example, the fuse 6 maybe disposed on a power wire 4B which is located opposite the power wire 4A with respect to the power source 4 as well as on the power wire 4A.

The fuse element is unreplaceable when disposed in the sealed housing 2 as in each foregoing embodiment. Accordingly, the sealed electric compressor 1, 11, 21 or 31 can reliably prevented from starting after the protecting operation due to pressure rise, and the glass sealing portion or the like can be prevented from being broken by being subjected to repeated large stress and an accident caused by the breaking can be prevented.

Sixth Embodiment

Figure 6:
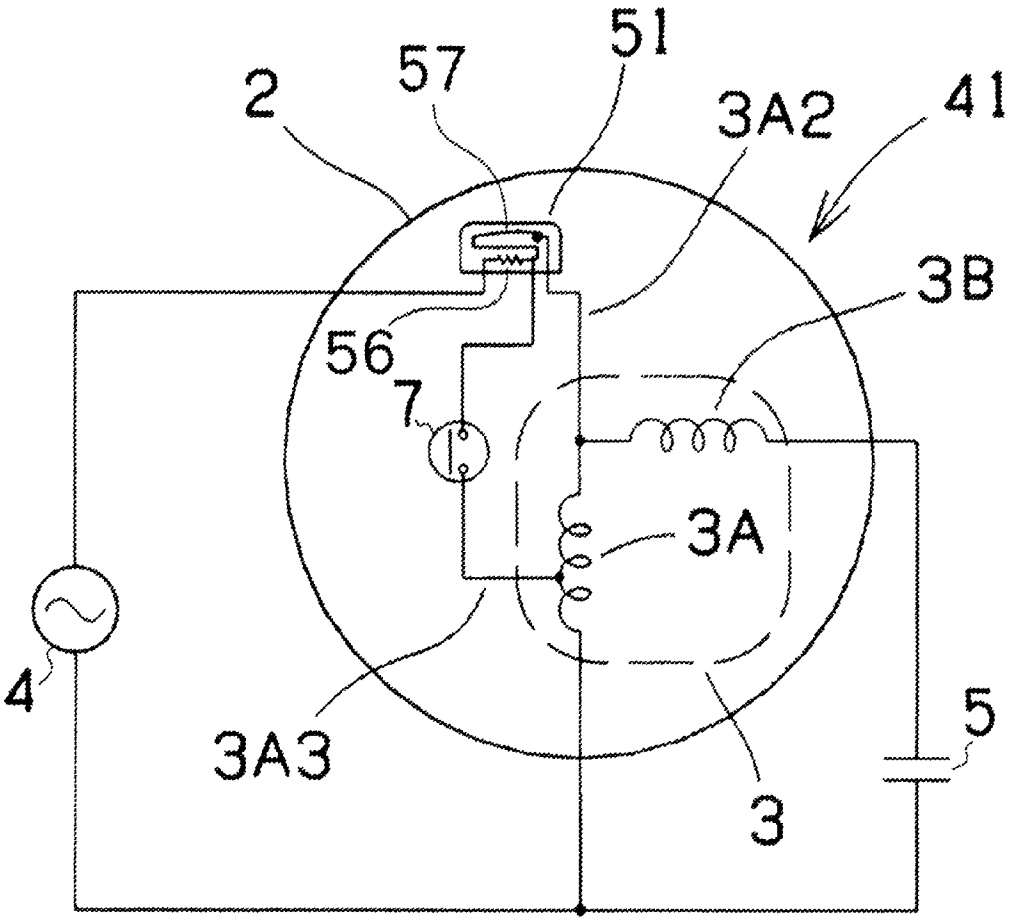
FIG. 6 is a view similar to FIG. 1, showing a sixth embodiment of the invention.

A sixth embodiment of the invention will be described with reference to FIGS. 6, 7A and 7B. Identical or similar parts in the sixth embodiment are also labeled by the same reference symbols as those in each foregoing embodiment, and the description of these components will be eliminated. The motor 3 driving the compressor is housed in the sealed housing 2 of the sealed electric compressor 41. The thermally responsive protector 51 is electrically series-connected between the motor 3 and the electrically conductive terminal pin of the hermetic terminal. The thermally responsive protector 51 comprises a thermally responsive contact mechanism including a thermally responsive element 57 such as a bimetal and a heater 56 applying heat to the thermally responsive contact mechanism, both of which are housed in a hermetic metal container, in the same manner as in a thermally responsive switch described in Japanese Patent Application Publication, JP-A-H10-144189, for example.

Figure 7A:
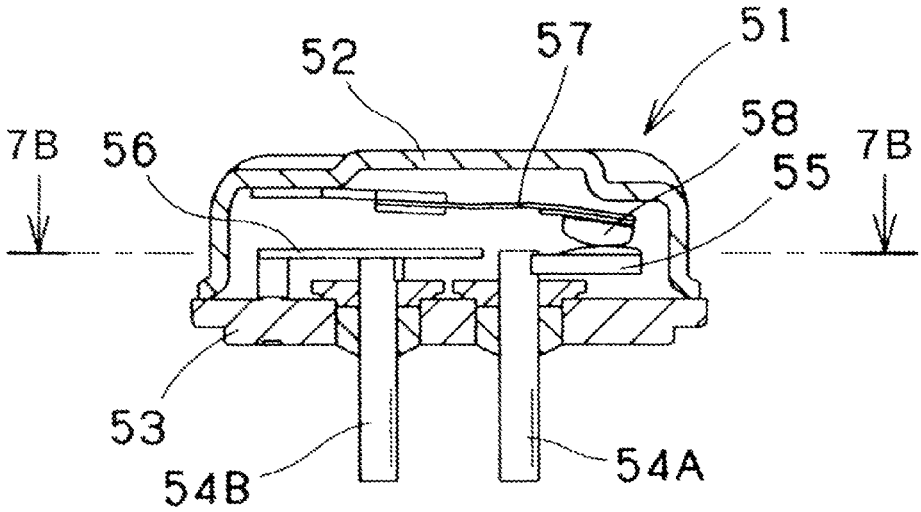
FIG. 7A is a sectional view of the thermally responsive protector for use with the sealed electric compressor as shown in FIG. 6.
Figure 7B:
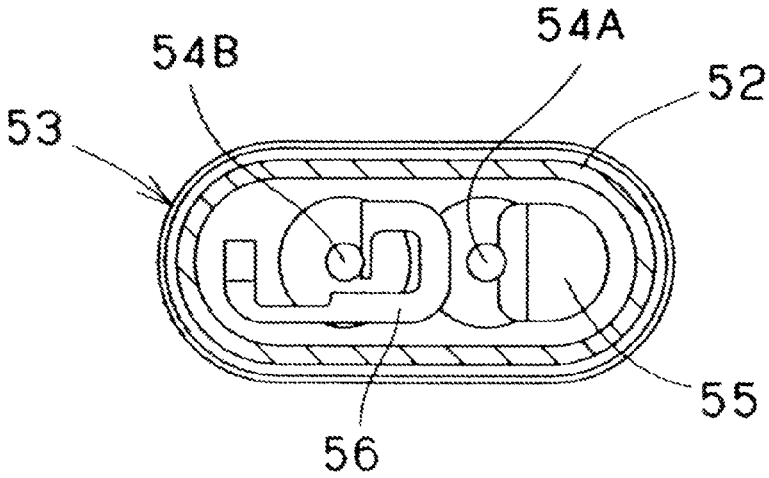
FIG. 7B is a sectional view of the thermally responsive protector taken along line 7B-7B in FIG. 7A.

FIG. 7A is a longitudinal section of the thermally responsive protector 51. FIG. 7B is a transverse cross-section of the thermally responsive protector 51 taken along line 7B-7B in FIG. 7A. The thermally responsive protector 51 comprises a metal container 52 and a header plate 53 fixed to the container 52 along an entire periphery of an opening of the container 52 by welding, both of which constitute a hermetic container having a sufficiently pressure-resistant container. Electrically conductive terminals 54A and 54B are inserted through the header plate 53 and insulated and fixed by an electrically insulating filler such as glass. The conductive terminal 54A has a portion thereof which is located inside the container 52 and to which a fixed contact 55 is fixed. The fixed contact 55 constitutes a switching mechanism together with a movable terminal 58 which will be described later. Furthermore, one end of the heater 56 is connected to the other conductive terminal 54B, and the other end of the heater 56 is fixed to the header plate 53.

The thermally responsive element 57, such as a bimetal, formed into a shallow dish shape has one end connected to the inner face of the container 52. The thermally responsive element 57 has a free end to which a movable contact 58 is secured. The movable contact 58 constitutes a thermally responsive contact mechanism together with the aforesaid fixed contact 5. Thus, the thermally responsive contact mechanism and the heater 56 are disposed in the hermetic container in a series-connected state.

In the thermally responsive protector 51, the conductive terminal 54A (an electrical end of the thermally responsive contact mechanism) is connected to the main winding 3A of the motor 3, and the conductive terminal 54B (an electrical end of the heater 56) is connected via the conductive terminal pin of the hermetic terminal to the power source 4. As a result, the operating current of the motor 3 flows through the conductive terminal 54A, the fixed contact 55, the movable contact 58, the thermally responsive element 57, the container 52, the header plate 53, the heater 56 and the conductive terminal 54B on the electric circuit in the thermally responsive protector 51.

The thermally responsive element 57 is self-heated and heated by heat from the heater 56 due to the operating current in the normal operation. However, since the heat of the thermally responsive element 57 is in equilibrium with the heat radiated externally, the thermally responsive element 57 maintains the energized state without reaching an operating temperature. When the sealed electric compressor 41 is overloaded for any cause, an amount of current flowing in the motor 3 is increased and an amount of heat generated in the thermally responsive protector 51 is also increased. When reaching the operating temperature, the thermally responsive element 57 reverses the curvature thereof with snap action to separate the movable contact 58 from the fixed contact 55, thereby cutting off current.

Furthermore, the normally-off type pressure switch 7 has one end connected via the lead wire 3A3 drawn from the middle of the main winding 3A in parallel to the main winding 3A in the embodiment. The pressure switch 7 has the other end connected to the header plate 53 or the container 52 that serves as an electrical middle point between the contact mechanism of the thermally responsive protector 51 and the heater 56. In the normal operation, the pressure in the sealed housing 2 is not less than the operating pressure of the pressure switch 7, whereupon the current flowing via the motor 3 also flows into the heater 56. When the motor 3 is overloaded such that overcurrent flows, the thermally responsive element 57 is operated. However, the heater 56 is not melted although the overcurrent flows therethrough.

When the refrigerant pressure in the sealed housing 2 rises for any cause (the clogging of the discharge pipe or the like) and the pressure switch 7 is operated, the short-circuit current is caused to flow into the heater 56 of the thermally responsive protector 51. The short-circuit current is set so as to be sufficiently larger than a supply current to the motor 3 during the operation under the overloaded condition. Accordingly, when subjected to the short-circuit current, the heater 56 serving as the fuse element is instantaneously melted, thereby cutting off the electrical path. The thermally responsive protector 51 is serially disposed between the motor 3 and the power source 4. Accordingly, energization of the motor 3 is reliably interrupted by the meltdown of the heater 56. Thus, the heater 56 which constitutes at least a part of the electrical circuit in the thermally responsive protector 51 is used as the fuse element. Consequently, the number of components of the thermally responsive protector 51 can be reduced, and an assembling work for the thermally responsive protector 51 can be rendered easier.

In the sixth embodiment, the heater 56 is disposed in the sealed container of the thermally responsive protector 51, which is a limited space. Accordingly, in order that other components and the sealed container may be prevented from being broken by arc in the meltdown of the heater 56, the pressure switch 7 is brought into contact with the middle of the main winding 3A so that an amount of current during the short-circuit is suppressed by partial shorting. Instead of the above-described connecting manner, the limiting resistor may be connected in series to the pressure switch 7 as described above. Furthermore, current short-circuiting the entire main winding 3A of the motor 3 can be caused to flow when the heater 56 is operated as the fuse element without hitch (for example, when the structure protecting other portions from arc produced during meltdown of the heater 56 is provided in the thermally responsive protector 51).

Furthermore, the thermally responsive protector 51 may be disposed outside the sealed housing 2 although disposed in the sealed housing 2 of the sealed electric compressor 41 in the embodiment. In this case, the thermally responsive protector 51 is connected via the conductive terminal pins provided on the hermetic terminal to the motor 3 and the pressure switch 7. Furthermore, since the exterior of the sealed housing 2 is not exposed to high-pressure refrigerant contrary to the interior of the sealed housing 2, a heat-resistant resin case may be used as the container of the thermally responsive protector 51.

INDUSTRIAL APPLICABILITY

As described above, differing from the conventional sealed electric compressors, the sealed electric compressor in accordance with the present invention can reliably detect an extraordinary rise of refrigerant pressure and perform a sufficient protecting operation, whereupon the breaking of the piping and damage accompanied with the piping breaking can be prevented. Furthermore, the number of components can be reduced and the assembling work and the handling of the thermally responsive protector can, be rendered easier by using the component of the thermally responsive protector as the fuse element.

The invention claimed is:

1. A sealed electric compressor which includes:

a sealed metal housing which houses an electric motor and a compressor therein;

a hermetic terminal provided in the sealed housing and having a plurality of conductive terminal pins conducting electric current between an interior and an exterior of the sealed housing;

a main winding and an auxiliary winding of the motor both connected to the conductive terminal pins, wherein the compressor compresses a refrigerant with the interior of the sealed housing serving as a refrigerant path;

a normally-off pressure switch disposed in the sealed housing and connected in parallel to the main winding, the pressure switch being operated to short-circuit the main winding when a refrigerant pressure in the sealed housing rises to an extraordinary high pressure state; and a fuse element which is connected in series to the main winding and the auxiliary winding and interrupts energization of the motor when an overcurrent flows in the motor with the main winding being short-circuited by the pressure switch.

2. The sealed electric compressor according to claim 1, wherein the fuse element is disposed in the sealed housing.

3. The sealed electric compressor according to claim 2, further comprising:

a thermally responsive protector series-connected between the motor and the conductive terminal pin and energizing the motor with an operating current so as to protect the motor, wherein the thermally responsive protector includes a circuit at least a part of which operates as the fuse element.

4. The sealed electric compressor according to claim 3, wherein:

the thermally responsive protector includes a hermetic metal container and a thermally responsive contact mechanism and a heater both disposed in the hermetic container and connected in series to each other;

the thermally responsive contact mechanism has an electrical end connected to the main winding;

the heater has an electrical end connected via the conductive terminal pin to a power source;

the pressure switch has one of two ends which is connected in parallel to the main winding;

the pressure switch has the other end which is connected to an electrical neutral point between the thermally responsive contact mechanism and the heater; and the heater is operated as the fuse element.

5. The sealed electric compressor according to claim 1, further comprising:

a thermally responsive protector connected in series to the motor and energizing the motor with an operating current so as to protect the motor, wherein the thermally responsive protector includes a circuit at least a part of which operates as the fuse element.

6. The scaled electric compressor according to claim 5, that wherein:

the thermally responsive protector includes a container and a thermally responsive contact mechanism and a heater both disposed in the container and connected in series to each other;

the thermally responsive contact mechanism has an electrical end connected to the main winding;

the heater has an electrical end connected to a power source;

the pressure switch has one of two ends which is connected in parallel to the main winding;

the pressure switch has the other end which is connected to an electrical neutral point between the thermally responsive contact mechanism and the heater; and the heater is operated as the fuse element.

* * * * *